US005440775A

United States Patent [19]

Banks

[11] Patent Number: 5,440,775

[45] Date of Patent: Aug. 15, 1995

[54] TOILET BOWL SCRUBBER

[76] Inventor: Katherine L. Banks, Vitemb Rd., P.O. Box 50, Wallisville, Tex. 77597-0050

[21] Appl. No.: 213,734

[22] Filed: Mar. 16, 1994

[51] Int. Cl.[6] ..... A47L 13/12

[52] U.S. Cl. ..... 15/106; 15/164

[58] Field of Search ..... 15/105, 106, 107, 111, 15/114, 117, 164

[56] References Cited

U.S. PATENT DOCUMENTS

| | | | |
|---|---|---|---|
| 328,426 | 10/1885 | Nowlin | 15/106 X |
| 1,652,213 | 12/1927 | Pulver . | |
| 1,660,318 | 2/1928 | Anderson . | |
| 1,758,632 | 5/1930 | Wagner | 15/106 X |
| 1,848,868 | 3/1932 | Churchill . | |
| 2,228,067 | 1/1941 | Von Den Driesch | 15/164 |
| 2,232,269 | 2/1941 | Reuben | 15/106 |
| 2,242,004 | 5/1941 | Kapines | 15/160 |
| 2,878,501 | 3/1959 | Brennan | 15/164 |
| 3,369,269 | 2/1968 | Deck et al. | 15/114 X |
| 3,503,089 | 3/1970 | Coneway | 15/160 |
| 4,642,836 | 2/1987 | Bokmiller | 15/114 X |
| 4,762,133 | 8/1988 | Bayne et al. | 128/756 |
| 4,967,441 | 11/1990 | White | 15/114 |

FOREIGN PATENT DOCUMENTS

| | | | |
|---|---|---|---|
| 369769 | 1/1907 | France | 15/164 |
| 11735 | 3/1934 | United Kingdom | 15/106 |

*Primary Examiner*—Christopher K. Moore
*Attorney, Agent, or Firm*—Harrison & Egbert

[57] ABSTRACT

A toilet bowl scrubber having a handle with a linear configuration, a first brush connected to one end of the handle, an arm extending outwardly of the handle between the first brush and an opposite end of the handle, and a second brush affixed to an end of the arm opposite the handle. The first brush has tufts of bristles affixed thereto extending perpendicular to a longitudinal axis of the handle. The arm includes a first arm portion extending outwardly perpendicular to the handle and a second arm portion extending in a direction from the first arm portion away from the first brush. The second brush is affixed to an end of the second arm portion opposite the first arm portion. The second arm portion extends upwardly at a 45° angle from the first arm portion.

19 Claims, 1 Drawing Sheet

TOILET BOWL SCRUBBER

TECHNICAL FIELD

The present invention relates to apparatus for the cleaning of toilets. More particularly, the present invention relates to toilet bowl scrubbing devices which include a means for under-the-rim cleaning.

BACKGROUND ART

One of the most difficult places to keep free from lime deposits in a toilet bowl is the area under the rim where flush water is directed into the bowl. The ordinary conventional toilet bowl brush is able go reach those areas to some extent, but generally does not have Sufficient scrubbing power to remove the deposits. Such deposits have the capability of harboring and propagating bacteria as well as becoming discolored and visually unattractive.

Although it is highly desirable that this under-the-rim area of the bowl be regularly cleaned to impede the growth of lime deposits and microorganisms, it has not been a common practice to do so. The major reason for this is that the location under-the-rim is resistant to ordinary soft bristle toilet bowl brushes as well as the fact that the ordinary brush does not reach well into this area. As such, there is a great need for a cleaning device capable of being manipulated into the under-the-rim area of the toilet fixture and performing scrubbing action to physically remove lime deposits and associated debris.

The cleaning of a toilet bowl can often be a time consuming procedure. Conventional toilet bowl cleaners require a scrubbing action throughout all of the surfaces of the toilet bowl. Often, a great deal of manual manipulation and "elbow power" must be employed so as to properly clean the toilet bowl. Standard toilet bowl cleaning devices are not properly designed for both ergonomic arid efficiency concerns.

In the past, a variety of toilet bowl scrubbing devices have been developed in an effort to reach the under-the-rim area. For example, U.S. Pat. No. 4,967,441, issued on Nov. 6, 1990, to R. A. White, teaches a standard toilet bowl brush which includes a forwardly and upwardly canted lance. A steel wool or other harsh scrub pad is placed on this lance so as to enable under-the-rim scrub action where hard deposits build up and discolor occurs from water deposits. The under-the-rim scrub brush extends outwardly from an end of the brush opposite to the handle of the brush. As a result, this device may properly accomplish the under-the-rim scrub action, but fails to accommodate ergonomic and efficiency concerns. The under-the-rim scrubbing activity occurs as a separate and independent action from the standard toilet bowl scrubbing procedure.

U.S. Pat. No. 1,660,318, issued on Feb. 28, 1928, to J. I. Anderson teaches a rounded brush head which has outwardly extending bristles, at the back of the brush, for the purpose of cleaning the rim of the toilet bowl. These outwardly extending back bristles facilitate the under-the-rim cleaning. Unfortunately, this arrangement of bristles does not provide the necessary resistance so as to carry out the proper scrubbing activity in the under-the-rim area. This is especially true since only a few bristles are arranged so as to extend outwardly of the brush head.

U.S. Pat. No. 1,848,868, issued on Mar. 8, 1932, to T. R. Churchill and U.S. Pat. No. 2,242,004, issued on May 13, 1941, to F. J. Kapinos teach round edge brush heads. Each of these brushes is particularly designed to facilitate the under-the-rim cleaning action during the cleaning of toilet bowls. Each of these patents describes a brush system which employs rearwardly projecting bristles that extend, outwardly, at an angle from the main brush. Once again, the cleaning action provided by these outwardly extending bristles is unlikely to accomplish the necessary scrubbing action, in an ergonomically efficient manner, for the proper cleaning of under-the-rim deposits.

U.S. Pat. No. 2,878,501, issued on Mar. 24, 1959, to M. J. Brennan teaches a brush that is particularly designed for the under-the-rim cleaning action. Bristles are affixed to an arm extending outwardly of a handle at the bottom of a handle. The bristles are arranged in an arcuate fashion so as to accommodate the curvature of the toilet bowl.

It is an object of the present invention to provide a toilet bowl scrubber that effectively cleans the under-the-rim deposits.

It is another object of the present invention to provide a toilet bowl scrubber that can carry out the under-the-rim cleaning in an efficient and ergonomically practical manner.

It is a further object of the present invention to provide a toilet bowl scrubber that is easy to use, easy to manufacture, and relatively inexpensive.

These and other objects and advantages of the present invention will become apparent from a reading of the attached specification and appended claims.

SUMMARY OF THE INVENTION

The present invention is a toilet bowl scrubber that comprises a handle having a linear configuration, a first brush connected to one end of the handle, an arm extending outwardly of the handle between the first brush and an opposite end of the handle, and a second brush affixed to an end of the arm opposite the handle. The first brush has tufts of bristles affixed thereto. These tufts of bristles extend perpendicular to a longitudinal axis of the handle. The first brush has a semi-parabolic cross-section. The first brush has a wide end adjacent the handle. The first brush has a circumference of between ten and eleven inches at the wide end. The first brush has an end positioned approximately three inches from the connection of the first brush with the handle. The arm of the present invention includes a first arm portion extending outwardly perpendicular to the handle, and a second arm portion extending upwardly from an end of the first arm portion opposite the handle. The second brush is affixed to an end of the second arm portion opposite the first arm portion. The handle and the first and second arm portions are integrally formed together. The second arm portion extends upwardly at a 45° angle from the first arm portion. The first arm portion has a length of between 2 and 2½ inches. The second arm portion has a length of between 1 and 1½ inches. The second brush is of a size smaller than the first brush. The second brush extends upwardly in a different direction than the first brush. The second brush has tufts of bristles which extend outwardly perpendicular to a longitudinal axis of the second arm portion.

The arm extends outwardly of the handle at a location approximately ⅓ of the length of the handle from the first brush. The handle has a hole formed therethrough at an end opposite the first brush. The handle has a first shoulder extending circumferentially therearound adjacent the first brush. The arm has a second shoulder extending circumferentially therearound adjacent the second brush. The handle has a circumference of no more than 2½ inches.

DETAILED DESCRIPTION OF THE INVENTION

Figure 1:
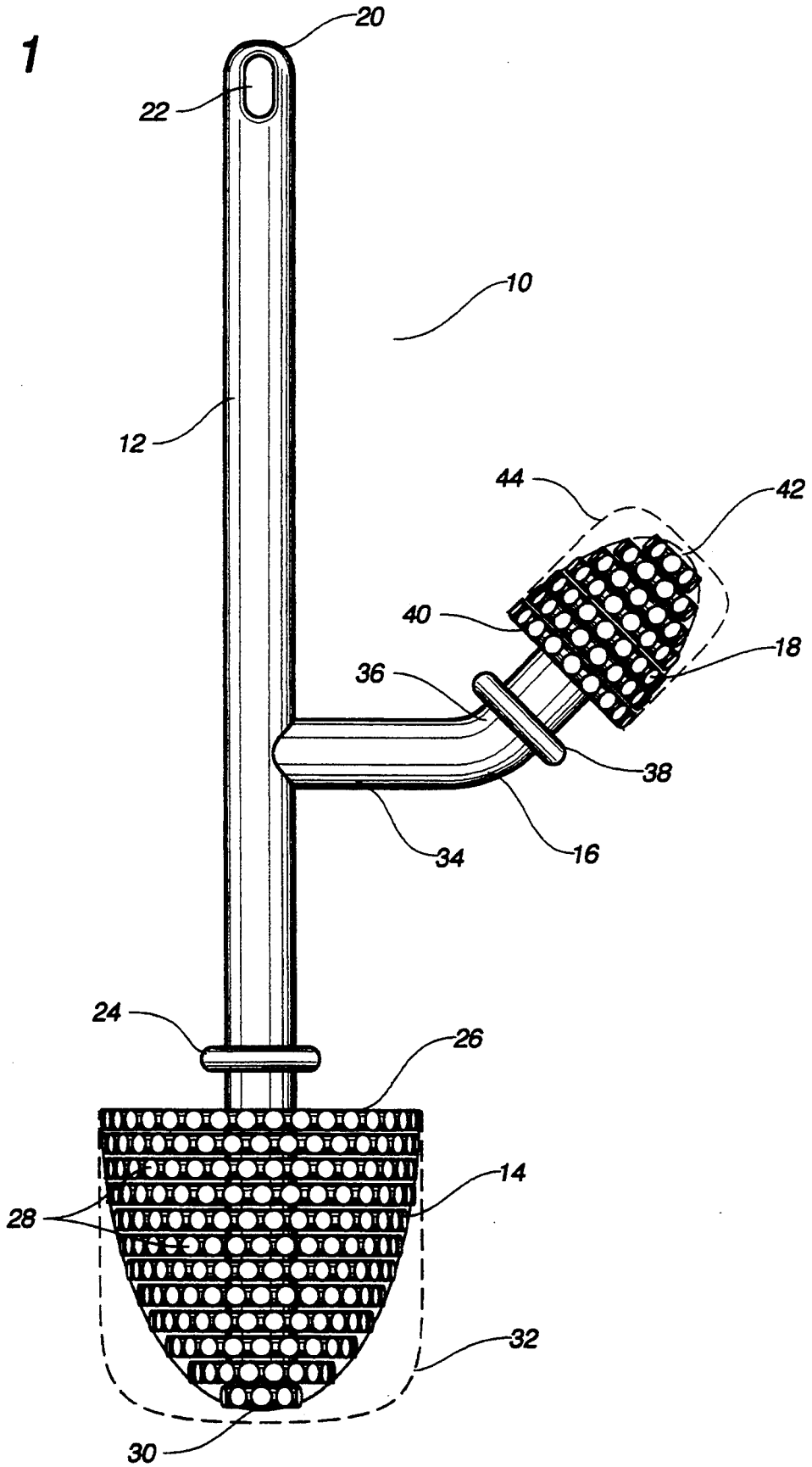
FIG. 1 is a side elevational view of the toilet bowl scrubber in accordance with the preferred embodiment of the present invention.

Referring to FIG. 1, there is shown at 10 the toilet bowl scrubber in accordance with the preferred embodiment of the present invention. The toilet bowl scrubber 10 includes a handle 12, a first brush 14, an arm 16, and a second brush 18. As can be seen, the first brush 14 is connected to one end of the handle 12. The arm 16 extends outwardly from the handle 12 between the first brush 14 and an opposite end 20 of handle 12. The second brush 18 is affixed to an end of the arm 16 opposite the handle 12.

The handle 12 is of a generally linear configuration from the brush 14 to the end 20. A hole 22 is formed adjacent to the end 20 of handle 12. Hole 22 facilitates the ability to hang the toilet bowl scrubber 10 o f the present invention upon a hook or a nail. The handle 12 is generally made of a rigid polymeric material. The handle can be round or tapered. Ideally, the handle 12 should have a circumference of no more than 2¼ inches at its thickest point. It is important to keep the circumference of the handle 12 as small as possible so as to facilitate the proper gripping of the handle 12 and the ability to manipulate the handle 12 in a proper fashion. The handle 12 includes a shoulder 24 extending around its circumference adjacent to the brush 14. The shoulder 24 is configured adjacent to the brush 14 so as to impart some rigidity to the handle adjacent to the brush 14. The shoulder 24 tends to prevent any distortion or fracturing of the handle 12 at the area where the greatest forces are imparted to the handle 12. It can be seen that the arm 16 extends outwardly from the handle 12 at a location approximately ⅓ of the length of the handle 12 from the first brush 14. In terms of actual dimensions, the arm 16 will be affixed to handle 12 approximately four inches from the back end 26 of brush 14. The handle 12 extends for approximately eight inches upwardly from the arm 16. The back end 26 of the first brush 14 is positioned approximately ½ inch from the shoulder 24.

The first brush 14 has tufts of bristles 28 affixed thereto. These tufts of bristles extend perpendicular to a longitudinal axis of the handle 12. The first brush 14 has a semi-parabolic cross-section or a blunt cone configuration. The back end 26 of the first brush 14 is the widest portion of the first brush 14. This wide end 26 is adjacent to the end of handle 12. The wide end of the first brush 14 has a circumferentially of between ten and eleven inches. The narrower end 30 of the first brush 14 extends approximately three inches from the back end 26. The dotted lines 32 show an alternative configuration of the first brush 14 in which the end 30 has a blunter configuration. It can be seen that the first brush 14 is slightly tapered and rounded on its ends. This rounded configuration facilitates the ability of the first brush 14 to properly clean the curved surfaces of the toilet bowl. The perpendicular orientation of the tufts of bristles 28 facilitates the ability to properly clean the surfaces of the toilet bowl. The rounded configuration of the first brush 14 can extend, for a great distance, into the drain hole of the toilet bowl.

Arm 16 is made up of a first arm portion 34 and a second arm portion 36. The first arm portion 34 extends outwardly perpendicular to the handle 12. The second arm portion 36 extends upwardly from an end of the first arm portion 34 opposite the handle 12. The second brush 18 is affixed to an end of the second arm portion 36 opposite the first arm portion 34. In normal use, the handle 12, the first arm portion 34 and the second arm portion 36 are integrally formed together. Importantly, in the preferred embodiment of the present invention, the second arm portion 36 will extend upwardly at a 45° angle from the first arm portion 34. This angling of the second arm portion 36 is necessary to properly facilitate the positioning of the second brush 18 for under-the-rim cleaning action. The proper construction of the toilet bowl scrubber 10 of the present invention will have the first arm portion 34 with a length of between 2 and 2½ inches. The second arm portion 36 will have a length of between 1 and 1½ inches. A second shoulder 38 is formed on the second arm portion 36 and extends circumferentially therearound adjacent to the second brush 18. The second shoulder 38 further serves to provide structural rigidity to the area of the arm 16 encountering the greatest amount of cleaning force. The shoulder 38 is positioned approximately ½ inch from the back end 40 of the second brush 18.

The second brush 18 has a size which is smaller than that of the first brush 14. The second brush 18 also includes a plurality of bristles (similar to those shown on the first brush 14) which extend outwardly perpendicular to a longitudinal axis of the second arm portion 36. As can be seen, the second brush 18 extends outwardly in a different direction than that of the first brush 14. The second brush 18 has a circumference of approximately six inches at the back end 40. The forward end 42 of the second brush 18 is positioned approximately two inches from the end of the second arm portion 36. The broken line 44 illustrates that the second brush 18 can have a blunter configuration, if necessary. The second brush 18 has a blunt cone-like configuration.

The toilet bowl scrubber 10 of the present invention achieves advantages not found in prior art toilet bowl scrubbing brushes. The orientation of the second brush 18 is positioned relative to the first brush 14 so that under-the-rim cleaning actions can occur simultaneously with the scrubbing of the toilet bowl. The under-the-rim cleaning can be carried out simultaneously with similar motions as used for the cleaning of the remainder of the toilet bowl. The rigid plastic material which is used for the construction of the scrubber 10 assures that strong cleaning action is imparted to the under-the-rim area of the toilet bowl. The strength of the bristles 18 are amplified by the use of the rigid plastic material for supporting the second brush 18 relative to the handle 12. The angled relationship of the arm 16 assures that the second brush 18 is directed toward the under-the-rim area. Even when the first brush 14 extends, as far as possible, into the bottom of the toilet bowl, the sides of the second brush 18 will be cleaning the sides of the toilet bowl. The curved surface of the second brush 18 assures conformity with the curved surfaces of the toilet bowl. As Such, the present invention is a superior brush for the cleaning of toilet bowls.

The present invention achieves a great deal of ergonomic efficiency in its use.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A toilet bowl scrubber comprising:

a handle having a linear configuration;

a first brush connected to one end of said handle;

an arm extending outwardly of said handle between said first brush and an opposite end of said handle;

an arm extending outwardly of said handle between said first brush and an opposite end of said handle; and a second brush affixed to an end of said arm opposite said handle, said arm comprising:

a first arm portion extending outwardly perpendicular to said handle; and a second arm portion extending in a direction from said first arm portion away from said first brush, said second brush affixed to an end of said second arm portion opposite said first arm portion.

2. The scrubber of claim 1, said first brush having tufts of bristles affixed thereto, said tufts of bristles extending perpendicular to a longitudinal axis of said handle.

3. The scrubber of claim 2, said first brush having a semi-parabolic cross-section, said first brush having a wide end adjacent said handle.

4. The scrubber of claim 3, said first brush having a circumference of between ten and eleven inches at said wide end, said first brush having an end positioned approximately three inches from the connection of said first brush with said handle.

5. The scrubber of claim 1, said handle and said first and second arm portions being integrally formed together.

6. The scrubber of claim 1, said second arm portion extending upwardly at a 135° angle from said first arm portion.

7. The scrubber of claim 6, said first arm portion having a length of between 2 and 2½ inches, said second arm portion having a length of between 1 and 1½ inches.

8. The scrubber of claim 1, said second brush having a size smaller than said first brush, said second brush extending in a different direction than said first brush.

9. The scrubber of claim 1, said arm extending outwardly of said handle at a location approximately ⅓ of the length of said handle from said first brush.

10. The scrubber of claim 1, said second brush having tufts of bristles extending outwardly perpendicular to a longitudinal axis of said second arm portion.

11. The scrubber of claim 1, said handle having a hole formed therethrough at an end opposite said first brush.

12. A toilet bowl scrubber comprising:

a handle having a linear configuration;

a first brush connected to one end of said handle; and an arm extending outwardly of said handle between said first brush and an opposite end of said handle a second brush affixed to an end of said arm opposite said handle, said handle having a first shoulder extending circumferentially therearound adjacent said first brush, said arm having a second shoulder extending circumferentially therearound adjacent said second brush.

13. The scrubber of claim 1, said handle having a circumference of no more than 2½ inches.

14. A toilet bowl scrubber comprising:

a handle;

a first brush connected to one end of said handle;

a first arm portion extending outwardly perpendicular to said handle;

a second arm portion extending in a direction from said first arm portion away from said first brush; and a second brush affixed to an end of said second arm portion opposite said first arm portion.

15. The scrubber of claim 14, said second arm portion extending at a 135° angle from said first arm portion.

16. The scrubber of claim 14, said handle and said first and second arm portions being integrally formed together of a rigid polymeric material.

17. The scrubber of claim 14, said second brush having a size smaller than said first brush, said second brush extending in a different direction than said first brush.

18. The scrubber of claim 14, said first arm portion extending outwardly of said handle at a location approximately ⅓ of the length of said handle from said first brush.

19. The scrubber of claim 14, said first brush having tufts of bristles affixed thereto, said tufts of bristles extending perpendicular to a longitudinal axis of said handle, said second brush having tufts of bristles extending outwardly perpendicular to a longitudinal axis of said second arm portion.

* * * * *